US005325111A

United States Patent [19]

Dietl

[11] Patent Number: 5,325,111

[45] Date of Patent: Jun. 28, 1994

[54] REMOVING WASTE INK FROM CAPPING STATION

[75] Inventor: Steven J. Dietl, Ontario, N.Y.

[73] Assignee: Xerox Corporation, Stamford, Conn.

[21] Appl. No.: 996,947

[22] Filed: Dec. 28, 1992

[51] Int. Cl.[5] ..... B41J 2/165

[52] U.S. Cl. ..... 347/30; 347/36

[58] Field of Search ..... 346/1.1, 140 R; B41J 2/165

[56] References Cited

U.S. PATENT DOCUMENTS

| | | | |
|---|---|---|---|
| 4,306,245 | 12/1981 | Kasugayama et al. | 346/140 R |
| 4,401,990 | 8/1983 | Aiba et al. | 346/75 |
| 4,567,494 | 1/1986 | Taylor | 346/140 R |
| 4,638,337 | 1/1987 | Torpey et al. | 346/140 R |
| 4,679,059 | 7/1987 | Dagna | 346/140 R |
| 4,745,414 | 5/1988 | Okamura et al. | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 4,935,753 | 6/1990 | Lehmann et al. | 346/140 R |
| 5,040,000 | 8/1991 | Yokoi | 346/140 R |
| 5,055,856 | 10/1991 | Tomii et al. | 346/1.1 |
| 5,257,044 | 10/1993 | Carlotta et al. | 346/140 R |

*Primary Examiner*—Benjamin R. Fuller
*Assistant Examiner*—Alrick Bobb
*Attorney, Agent, or Firm*—Oliff & Berridge

[57] ABSTRACT

A process and apparatus for removing waste ink from a capping station on a low cost integral capping, priming and wiping station for a thermal ink jet printer. In particular, the prime operation is repeated so that the scanning carriage (containing the ink jet printhead) travels past the capping position which breaks the vacuum seal and causes waste ink in the cap volume to be released into the pump chamber, thus cleaning the cap volume of excess ink. The additional prime cycle does not remove ink from printhead orifices because the scanning carriage travels away from the capping position as vacuum is applied.

12 Claims, 4 Drawing Sheets

REMOVING WASTE INK FROM CAPPING STATION

BACKGROUND OF THE INVENTION

1. Field of the Invention

This invention relates to capping stations for thermal ink jet printing apparatus and is concerned, more particularly, with providing a method to remove waste ink from capping stations on low cost integral capping, priming and wiping stations.

2. Description of Related Art

An ink jet printer of the so-called "drop on demand" type has at least one printhead from which droplets of ink are directed towards a recording medium. Within the printhead, the ink may be contained in a plurality of channels and energy pulses are used to cause the droplets of ink to be expelled, as required from orifices at the ends of the channels.

In a thermal ink jet printer, the energy pulses are usually produced by resistors, each located in a respective one of the channels, which are individually addressable by current pulses to heat and vaporize ink in the channels. As voltage is applied across a selected resistor, a vapor bubble grows in that particular channel and ink bulges from the channel orifices. At that stage, the bubble begins to collapse. The ink within the channel retracts and separates from the bulging ink which forms a droplet moving in a direction away from the channel orifice and towards the recording medium. The channel is then refilled by capillary action, which in turn draws ink from a supply container. Operation of a thermal ink jet printer is described in, for example, U.S. Pat. No. 4,849,774 to Endo et al.

One particular form of thermal ink jet printer is described in U.S. Pat. No. 4,638,337 to Torpey et al. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when a printer is not in use or is idle for extended periods. The capping of the printhead is intended to prevent the ink in the printhead from drying out. There is also a need to prime a printhead before use, to ensure the printhead channels are completely filled with ink and contain no contaminants or air bubbles. Maintenance and/or priming stations for the printheads of various types of ink jet printer are described in, for example, U.S. Pat. No. 4,745,414, to Okamura et al.; U.S. Pat. No. 4,855,764, to Humbs et al.; U.S. Pat. No. 4,853,717, to Harmon et al.; and U.S. Pat. No. 4,746,938, to Yamamori et al., while the removal of gas from the ink reservoir of a printhead during printing is described in U.S. Pat. No. 4,679,059, to Dagna. Other ink jet printer nozzle cleaning and sealing devices are described in, for example, U.S. Pat. No. 4,401,990, to Aiba et al.; U.S. Pat. No. 4,567,494, to Taylor; U.S. Pat. No. 5,055,856, to Tomii et al.; U.S. Pat. No. 4,935,753, to Lehmann et al.; U.S. Pat. No. 4,306,245, to Kasugayama et al.; and U.S. Pat. No. 5,040,000, to Yokoi.

It has been found that the printing operation or the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress, and like the ink residue, can also have a deleterious effect on print quality. It has previously been proposed, in U.S. Pat. No. 4,853,717, to Harmon et al., that a printhead should be moved across a wiper blade at the end of a printing operation so that paper dust and other contaminants are scraped off the orifice plate before the printhead is capped. In U.S. Pat. No. 4,745,414, to Okamura et al., it has been proposed to provide an ink jet printer with a motorized ink discharge recovery device that employs a suction pump and a wiping means in a one cycle sequence for preventing unsatisfactory ink discharge of a recording head. It has also been proposed, in U.S. Pat. No. 4,746,938, to Yamamori et al., that an ink jet printer should be provided with a washing unit which, at the end of a printing operation, directs water at the face of the printhead to clean the latter before it is capped.

A typical thermal ink jet printer, as shown in FIG. 1, has a printhead (with integral ink supply) 18 mounted on a printer fast scan carriage (scanning carriage) 19. The printhead 18 contains a plurality of ink channels which carry ink from the integral ink supply to respective ink ejecting orifices. In use, the scanning carriage 19 reciprocates, as indicated by arrow 19*a*, and droplets of ink are expelled by selected ones of the printhead orifices (such as in the manner previously described) and are directed towards a recording medium 69. During each pass of the scanning carriage 19 the recording medium 69 is stationary. At the end of each pass, the recording medium 69 is stepped up to the next print line in the direction of arrow 69*a*.

At one side of the typical thermal ink jet printer, outside the printing zone, which encompasses the width of the recording medium 69, is a typical maintenance station 71. At the end of the printing operation, the scanning carriage 19 is parked in a maintenance position confronting the maintenance station 71, which comprises a chamber 73 and an associated suction pump 75 in communication with each other through a waste tank 77 and lines 79, 81 interconnecting the interior of the chamber 73 with the waste tank 77 and the waste tank 77 and the pump 75, respectively. The chamber 73 is movable towards and away from the printhead 18, as indicated by the arrow 73*a*, by, for example, a solenoid 83, and has a seal means 85 secured to a rigid wall 87 of the chamber 73.

The typical maintenance station 71 then, must provide a humid environment for the printhead orifices or nozzles, and must also perform the function of priming the printhead 18. As is known in the inkjet printer art, the priming operation draws ink from the ink supply and fills the printhead channels and also clears out air trapped in the printhead channels. A low cost, low volume vacuum or suction pump capable of drawing a partial vacuum of 65 to 140 inches of water is common.

A waste tank 77 collects waste ink during priming of the printhead 18.

The vacuum suction rises preferably in approximately two seconds to a point where the ink channels are well primed. When the typical maintenance station 71 is pulled away from the printhead 18 (as will be discussed in greater detail with respect to the inventive method described herein), air rushing in over the printhead 18 and maintenance station 71 clears any waste ink from the printhead face.

Further, another existing design of a simple priming and capping station has the problem of limited waste ink capacity which can result in print cartridge and machine contamination. This prior art design involves an integral capping and priming mechanism in which both the cap seal actuation and priming pump compression are provided by the motion of the scanning carriage (printhead holder). When the scanning carriage is scanned off the recording medium (e.g., paper) the scanning carriage encounters the capping station pawl which initially pushes the capping station to the printhead face via a rack and pinion mechanism. If the scanning carriage stops at that position, no priming takes place and the printhead remains capped. If the scanning carriage is driven further off the paper, the priming pump plunger, which is integral to the capping station, encounters the machine frame and both the plunger and a return spring are compressed. This action also serves to purge any waste ink from the priming pump chamber but, at this point, no priming of the printhead has occurred. The scanning carriage is then driven back to the capping position, where the cap seal is still in contact with the printhead face, and the spring is allowed to relax and drive the pump piston to perform a controlled prime operation. The scanning carriage remains in this position for a minimum of two seconds to allow an adequate amount of ink to be drawn from the printhead orifices. The excess ink is collected in the capping station volume. It is desirable, therefore, to remove this waste ink from the capping station volume after each prime.

SUMMARY OF THE INVENTION

It is thus an object of the invention to provide an improved method and apparatus for removing waste ink from low cost integral capping, priming and wiping stations associated with thermal ink jet printers.

Another object of the invention is to repeat the prime operation, however, this time to continue scanning carriage travel past the capping position thereby allowing the capping station to drop away from the printhead face. Thus, the vacuum provided by the second prime operation is used to withdraw ink from the capping station volume and into the pump chamber. This limits the amount of waste ink resident on the cartridge face after prime and eases the burden on the wiper blade.

These and other objects and advantages are obtained by the inventive method and apparatus for removing waste ink from the capping station using a low cost integral capping, priming and wiping station for thermal ink jet printers. The method is preferred for an integral capping and priming mechanism in which both the cap seal actuation and priming pump compression are provided by the motion of the scanning carriage (i.e., printhead holder).

In particular, the scanning carriage is scanned off the recording medium where it encounters the capping station pawl, which initially pushes the capping engagement means to the cartridge face by a known means, for example, a gear cam mechanism or a ramp. If the scanning carriage stops at that position, no priming takes place and the print cartridge remains capped. If the scanning carriage is driven further off the recording medium, the priming pump means, which is preferably integral to the capping station, encounters the machine frame and stops as a return spring is fully compressed. The scanning carriage is then driven back to the capping position, where the cap seal is still in contact with the printhead face, and the priming pump means performs a first prime operation. The drawn ink is collected in the capping station volume and in the pump chamber.

It is desirable to remove the waste ink from the capping station volume after each prime, therefore, the "prime" operation is repeated. This time, however, continuing the scanning carriage travel past the capping position, thereby allowing the capping station to drop away from the cartridge face. The vacuum provided by the second "prime" operation is thus used to withdraw ink from the capping station volume and into the pump chamber where it is removed to a waste sump rather than prime the printhead. This limits the amount of waste ink resident on the printhead face after prime and eases the burden on the wiper blade.

Other objects, advantages, and salient features of the invention will become evident from the detailed description which, taken in conjunction with the annexed drawings, discloses preferred embodiments of the invention.

BRIEF DESCRIPTION OF THE DRAWINGS

Referring now to the drawings which form part of this original disclosure.

DESCRIPTION OF THE PREFERRED EMBODIMENTS

Figure 1:
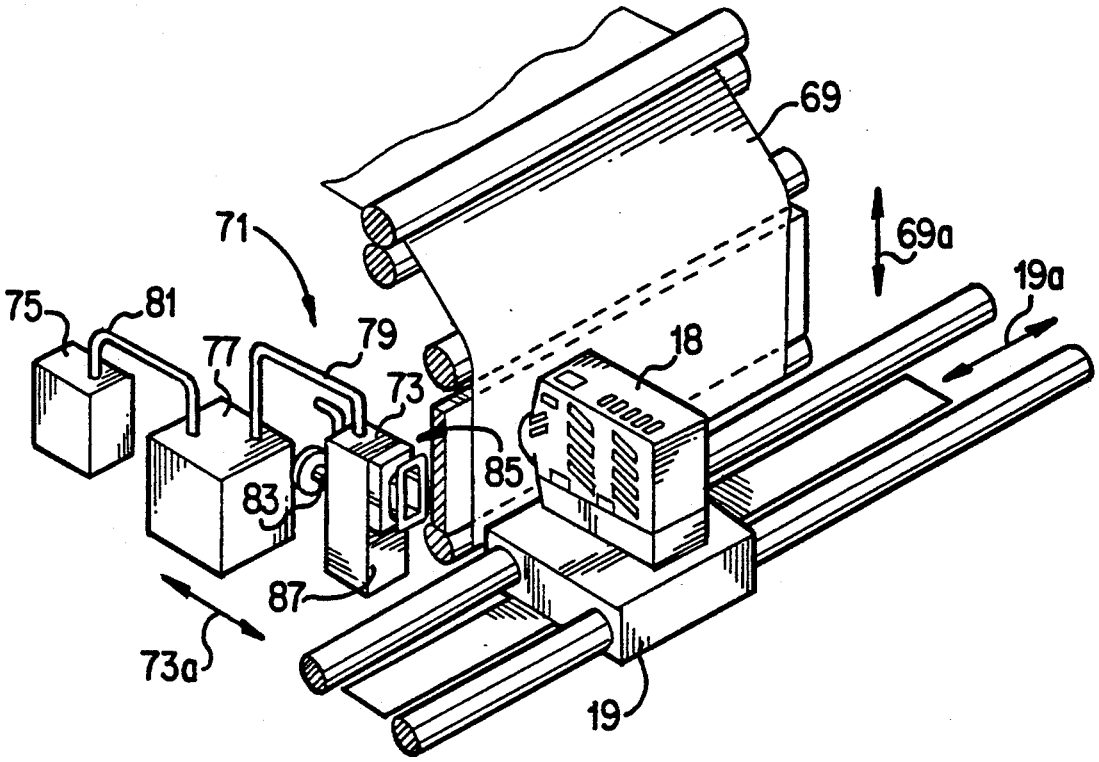
FIG. 1 RELATED ART
FIG. 1 is a schematic drawing of a partially shown thermal ink jet printer containing a typical maintenance station arrangement.

The method and apparatus for removing waste ink from a low cost integral, capping, priming and wiping station will be described in combination with the typical thermal ink jet printer of FIG. 1. The method is preferred for use with any low cost thermal ink jet printer with an integral capping, priming and wiping station. For a general understanding of the features of the present invention, reference is made to the drawings. In the drawings, like reference numerals have been used throughout to designate identical elements.

Figure 2:
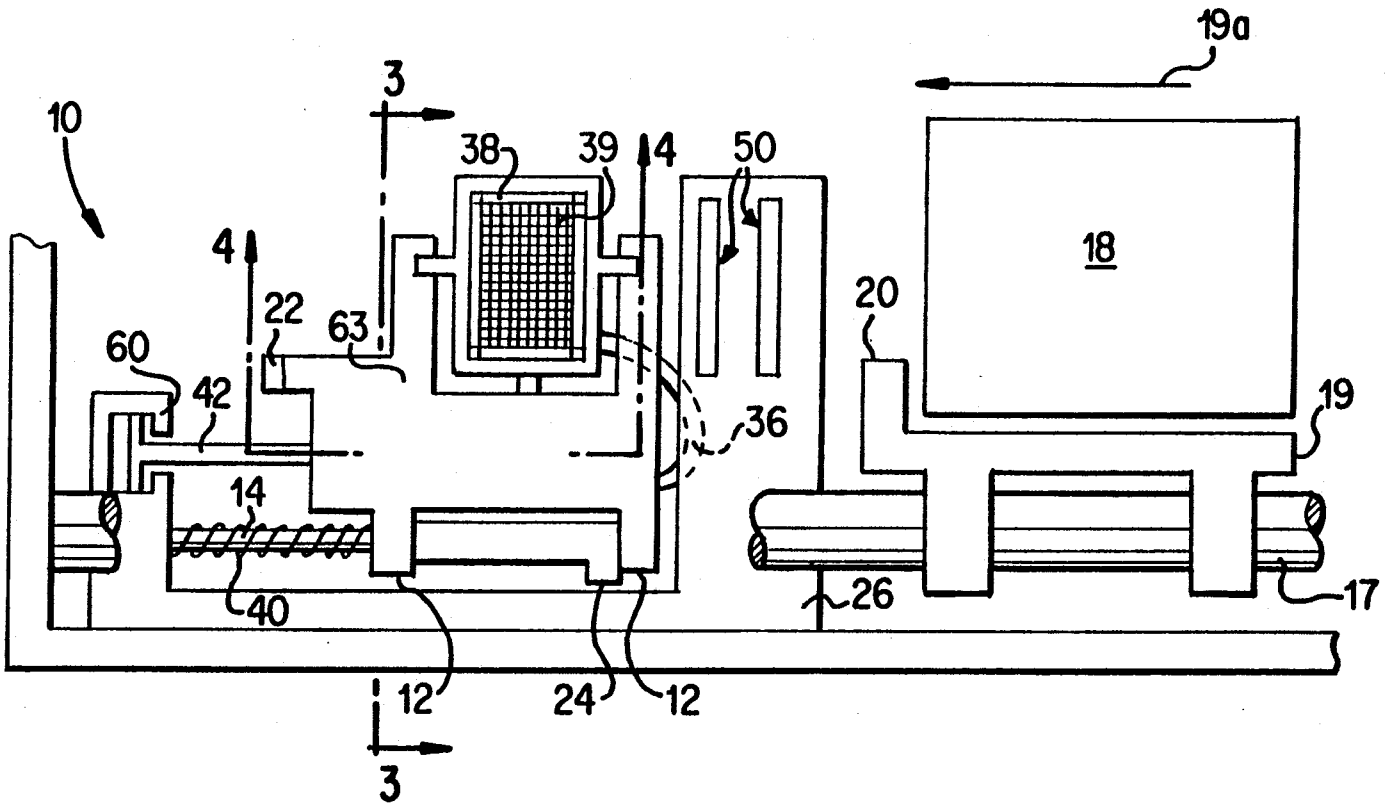
FIG. 2 is a schematic drawing of a partially shown thermal ink printer containing the integral capping, priming and wiping station of the invention.

In FIG. 2, the typical ink jet printer arrangement is modified to include an integral capping, priming and wiping station 10 (capping station) capable of moving in unison with the scanning carriage 19 however, the basic function and equipment layout described with respect to the typical ink jet printer remains except where modified below. The capping station 1 0 is located at one end of the thermal ink jet printer's fast scan rail 17. The architecture is designed for function, reduced cost and assembly ease.

The capping station 10 described herein is capable of moving by means of two bearings 12 which ride on a shaft 14 and sliding bearing surfaces 16 (see FIGS. 2 and 3) which are distanced from the shaft 14, thereby providing a stable yet movable stance. The capping station 10 is actuated by the scanning carriage 19. When the actuator edge 20 of the scanning carriage 19 contacts the actuator edge 22 of the capping station 10, the capping station 10 and scanning carriage 19 move in unison. Approximately 5 mm past initial contact, the pawl 24 is raised to a locked position via cams located on the frame 26. This prevents relative motion between the scanning carriage 19 and the capping station 10 which ensures proper capping during movement of the carriage. Additionally, the locking capability is provided to prevent the scanning carriage 19 from moving away from the capping station 10, and thus becoming uncapped, should the printer be moved or jostled.

Figure 3:
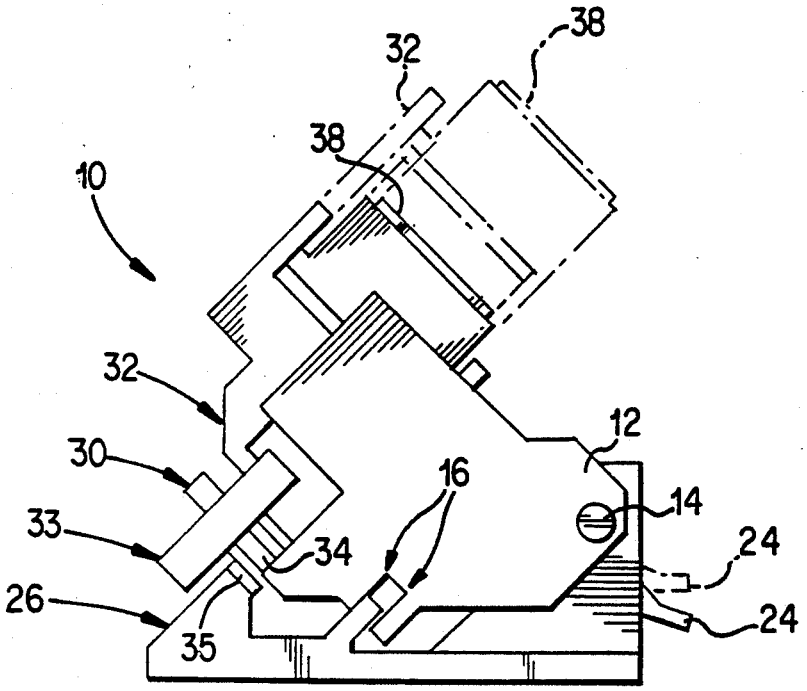
FIG. 3 is a sectional view taken along line 3—3 of FIG. 2 showing a capping, priming and wiping station of a thermal ink jet printer.

At the same point, the engagement means 32 is moved such that the cap seal 38 contacts the faceplate of the printhead 18, by means of a "gear cam" shaft feature 30. A gear cam 33 rotates via contacting teeth 34, 35 located on the lower cam portion and in frame 26 respectively, when the capping station 10 is moved relative to the frame 26. The gear cam 33 positions the capping engagement means 32 at the point where the cap seal 38 and the printhead 18 faceplate make contact (see FIG. 3, shown in dotted-line). The capping station 10 is further shown with a tube connection 36 to the priming pump chamber 62 (shown in FIG. 4) to prime the printhead 18 and carry away excess waste ink from the printhead 18 and cap volume 39.

As discussed above, an integral capping and priming mechanism in which the cap seal actuating and priming pump compression are provided by the motion of the capping station and scanning carriage is essential to this inventive method. Further, the priming pump housing 63 is molded or cast as an integral part of the capping, priming and wiping station 10.

Figure 4:
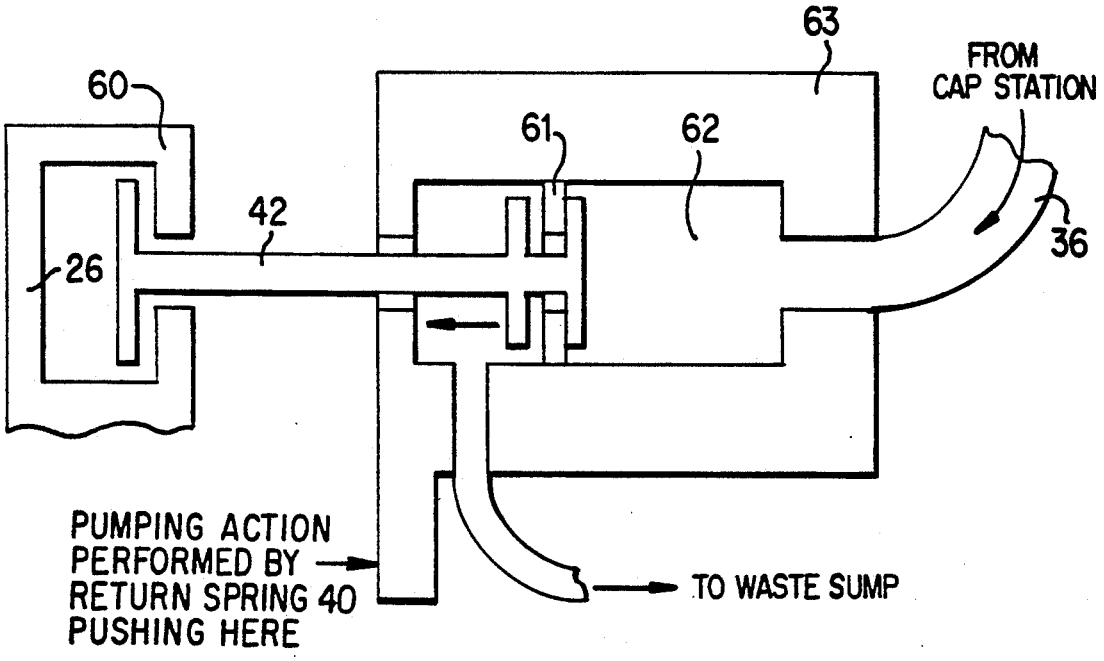
FIG. 4 is a sectional view taken along line 4—4 of FIG. 2 showing the integral priming pump means internal to the capping, priming and wiping station.

In particular, when the scanning carriage 19 is scanned off the recording medium 69, it encounters the actuator edge 22 of the capping station 10 which initially pushes the capping engagement means 32 to the faceplate of the printhead 18 through movement of a gear cam shaft 30, as discussed above (see FIG. 3). If motion stops at this position, no priming takes place and the printhead 18 remains capped. If the capped printhead 18 is driven further off the recording medium 69, the priming plunger 42, which is held in position by the plunger retainer 60 and is integral to the capping station 10, encounters the machine frame 26 and stops as the return spring 40 is fully compressed. When the capping station 10 and integral pump housing 63 are pushed to the right by action of the spring 40, i.e., back to the capping position, the priming plunger 42 also moves to the right until restrained by the plunger retainer 60. The priming plunger 42 then slides on the inside of the pump housing 63. This causes the sliding seal 61 to move to the left (as shown in FIG. 4) causing a resultant negative pressure in the pump chamber 62 which, in turn, pulls ink from the printhead orifices into the cap volume 39. The scanning carriage 19 remains in this position preferably for a minimum of two seconds to allow an adequate amount of ink to be drawn from the printhead orifices. This ink is collected in the cap station volume 39 and in the pump chamber 62. It is desirable to remove this waste ink from the cap station volume 39 after each prime.

Subsequently, the movements of the prime operation described above are repeated, i.e., the scanning carriage 19 is driven into the frame 26 and returned to the capping position. However, this time continuing return travel of the scanning carriage 19 past the capping position and, rather than priming the printhead 18, allowing the capping engagement means 32 to drop away from the printhead 18 faceplate. Thus, the vacuum provided by the second prime operation is used to withdraw ink from the cap volume 39 and into the pump chamber 62. This limits the amount of waste ink resident on the printhead 18 faceplate after prime and eases the burden on the wiper blade 50 which subsequently wipes the printhead 18 faceplate as the scanning carriage 19 travels past, moving the printhead 18 into position to begin printing upon the recording medium 69. Additionally, just before the printhead 18 and engagement means 32 separate, movement of the mated capping station 10 and scanning carriage 19 past the capping position causes the sliding seal 61 to move further to the left, thereby allowing the waste ink to pass to the left and out from the waste hole where it is collected by a waste sump (similar to waste tank 77 in FIG. 1). This action serves to purge any waste ink from the priming pump chamber 62.

Figure 5:
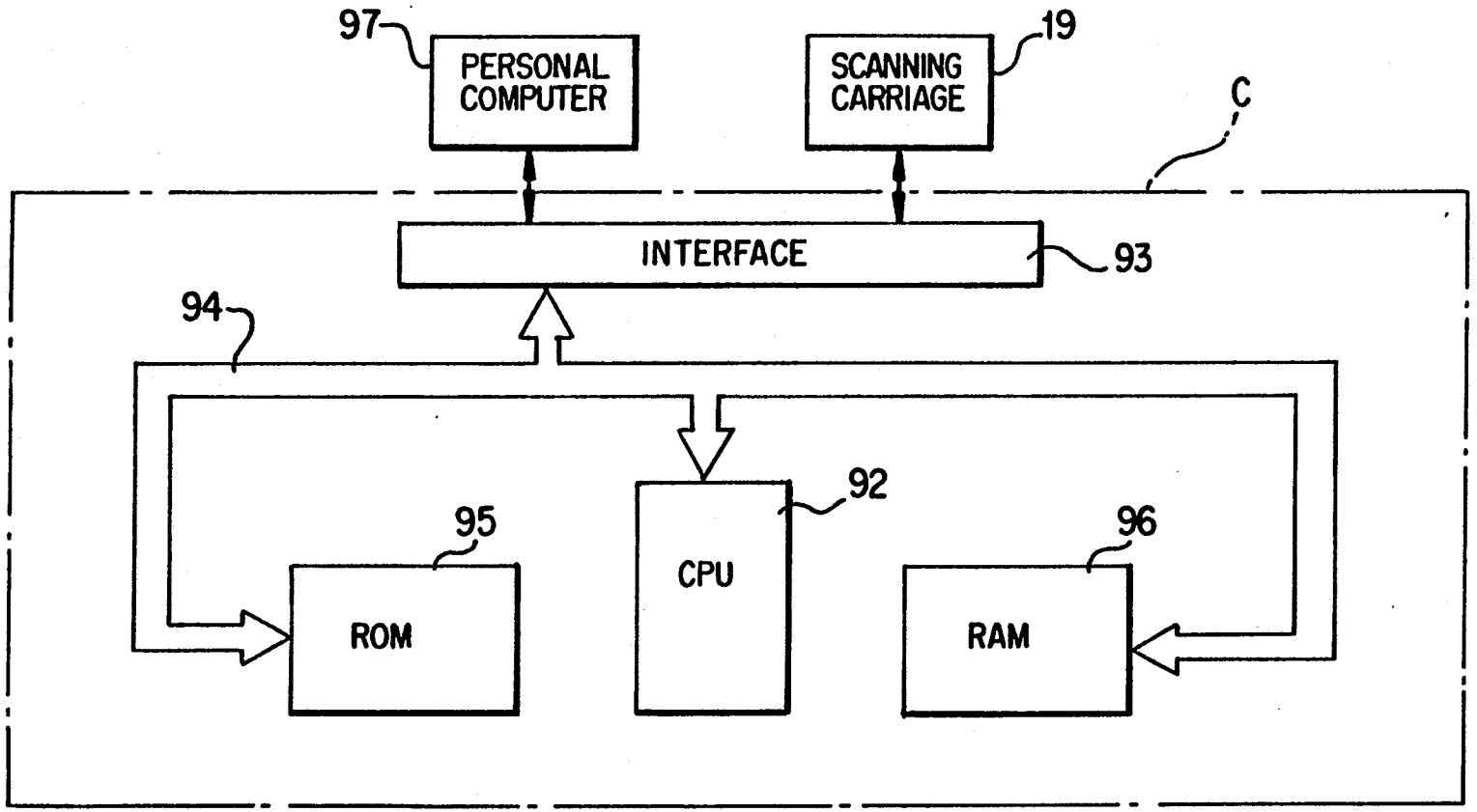
FIG. 5 is a block diagram showing the control means of the invention.

A control means C, which controls the scanning carriage 19 (through a suitable drive motor, well known in the art) to facilitate the process of removing waste ink from the cap volume 39 described above, is shown in the block diagram of FIG. 5. A scanning carriage controller C comprises a CPU 92, an interface 93 connected to the CPU 92 through a bus 94, a ROM 95, and a RAM 96. The control programs necessary to drive the scanning carriage 19 in accordance with the inventive method described herein, are found in the ROM 95.

Although the invention has been described with reference to a specific preferred embodiment, it is not intended to be limited thereto, rather those skilled in the art will recognize that variations and modifications may be made therein which are within the spirit of the invention and within the scope of the following claims.

What is claimed is:

1. A process for removing waste ink from a capping station for use in a thermal ink jet printer having an integral capping, priming and wiping station in which both cap seal actuation and priming pump operation are provided by motion of a scanning carriage, the scanning carriage carrying an ink jet printhead, the process comprising the steps of:

a) moving the scanning carriage off a recording medium to a capping position causing an engagement device connected to said capping station to engage a front face of said printhead;

b) moving the scanning carriage further off said recording medium causing a priming pump device integral with said capping station to encounter a machine frame connected to said capping station;

c) moving the scanning carriage back to said capping position causing the priming pump device to generate a first prime operation by drawing ink from each of a plurality of ink jet orifices contained on said printhead;

d) collecting the ink drawn from the ink jet orifices;

e) repeating step (b);

f) moving the scanning carriage back toward said capping position and continuing the scanning carriage travel past said capping position causing the engagement device to disengage from the front face of said printhead;

g) using a vacuum generated by moving the carriage back toward said capping position to withdraw waste ink from the engagement device which eases a wiper blade cleaning operation of the front face of said printhead during subsequent priming operations; and h) performing said wiper blade cleaning operation.

2. The process according to claim 1, wherein said first prime operation continues for at least 2 seconds to allow a priming vacuum to draw sufficient ink from each of said ink jet orifices.

3. A process for removing waste ink from a capping station for use in a thermal ink jet printer having an integral capping, priming and wiping station in which both cap seal actuation and priming pump operation are provided by motion of a scanning carriage, the scanning carriage carrying an ink jet printhead, the process comprising the steps of:

a) performing a first prime operation to draw ink from each of a plurality of ink jet orifices contained on a front face said printhead into an engagement device connected to the capping station;

b) moving the scanning carriage away from a capping position and a recording medium;

c) moving the scanning carriage back toward said capping position, causing a resultant vacuum in the capping station, and continuing the scanning carriage travel past said capping position;

d) using said vacuum to withdraw waste ink from the engagement device which eases a wiper blade cleaning operation of the front face of said printhead during subsequent priming operations; and e) performing said wiper blade cleaning operation.

4. The process according to claim 3, wherein said first prime operation further includes the steps of:

a) moving the scanning carriage off a recording medium to a capping position causing the engagement device to engage with the front face of said printhead;

b) moving the scanning carriage further off said recording medium causing a priming pump device to encounter a machine frame connected to said capping station;

c) moving the scanning carriage back to said capping position to cause the first prime operation; and d) collecting ink drawn from the ink jet orifices.

5. The process according to claim 4, wherein said first prime operation continues for at least 2 seconds to allow a priming vacuum to draw sufficient ink from each of said ink jet orifices.

6. The process according to claim 3, wherein continuing the scanning carriage travel past said capping position causes the capping station to drop away from the scanning carriage.

7. An apparatus for removing waste ink from a capping station for use in a thermal ink jet printer having an integral capping, priming and wiping station in which both cap seal actuation and priming pump operation are provided by motion of a scanning carriage, the scanning carriage carrying an ink jet printhead, the apparatus comprising:

a) means for moving the scanning carriage off a recording medium to a capping position where the scanning carriage encounters a capping station pawl which pushes a capping engagement device into contact with a face of the ink jet printhead;

b) means for moving the scanning carriage further off said recording medium causing a priming pump device, which is integral with said capping station, to encounter a machine frame connected to said capping station;

c) means for moving the scanning carriage back to said capping position, where said capping engagement device remains in contact with said ink jet printhead and said priming pump device performs a first prime operation to draw ink from each of a plurality of ink jet orifices contained on said printhead, said ink being collected in a capping station volume of said capping station and in a priming pump chamber of said priming pump device;

d) means for moving the scanning carriage so that the priming pump device will again encounter said machine frame;

e) means for moving the scanning carriage back toward said capping position and for continuing the scanning carriage movement past said capping position causing said capping engagement device to drop away from said ink jet printhead face, wherein a vacuum provided in the capping station by moving the scanning carriage back toward said capping position causes the withdrawal of waste ink from said capping station volume and into said pump chamber to limit an amount of waste ink deposited on said ink jet printhead face during subsequent priming operations, which eases a subsequent wiper blade cleaning operation of the face of said ink jet printhead; and f) a wiper blade cleaning means for cleaning said ink jet printhead face.

8. The apparatus according to claim 7, wherein said capping engagement device contacts said ink jet printhead by at least a gear cam shaft mechanism and a ramp.

9. The apparatus according to claim 8, wherein a gear cam rotates by contacting teeth in said machine frame.

10. The apparatus according to claim 9, wherein said gear cam positions said capping engagement device to a position where said capping engagement device contacts a front face of said ink jet printhead.

11. The apparatus according to claim 7, wherein said means for moving the scanning carriage back to said capping position includes a spring.

12. A process for removing waste ink from a capping station for use in thermal ink jet printer having an integral capping, priming and wiping station in which both cap seal actuation and priming pump operation are provided by motion of a scanning carriage, the scanning carriage carrying an ink jet printhead, the process comprising the steps of:

a) moving the scanning carriage off a recording medium to a capping position, causing the capping station to mate with the scanning carriage;

b) moving the scanning carriage, still mated to the capping station, further off said recording medium until encountering a machine frame member connected to the capping station;

c) moving the scanning carriage, still mated to the capping station, back to said capping position causing a first vacuum in the capping station which is used to prime the printhead and draw ink from each of a plurality of ink jet orifices contained on a face of said printhead;

d) collecting the ink drawn from the plurality of ink jet orifices;

e) repeating step (b);

f) moving the scanning carriage, still mated to the capping station, back toward said capping position, causing a second vacuum in the capping station;

g) moving the scanning carriage past said capping position causing the capping station to drop away from the scanning carriage;

h) using said second vacuum to withdraw waste ink from the capping station which eases a subsequent wiper blade cleaning operation of the face of said printhead; and i) performing said wiper blade cleaning operation.

* * * * *